US006011381A

United States Patent [19]

Andrei

[11] Patent Number: 6,011,381

[45] Date of Patent: Jan. 4, 2000

[54] THREE-PHASE AUTO TRANSFORMER WITH TWO TAP CHANGERS FOR RATIO AND PHASE-ANGLE CONTROL

[75] Inventor: Radu George Andrei, Columbus, Ohio

[73] Assignee: American Electric Power Service Corporation, Columbus, Ohio

[21] Appl. No.: 09/184,609

[22] Filed: Nov. 2, 1998

[51] Int. Cl.[7] ..... G05F 1/14

[52] U.S. Cl. ..... 323/215; 323/255

[58] Field of Search ..... 323/215, 209, 323/210, 251, 253, 254, 255

[56] References Cited

U.S. PATENT DOCUMENTS

| | | | |
|---|---|---|---|
| 1,871,168 | 8/1932 | Field . | |
| 1,992,809 | 2/1935 | Blume | 172/246 |
| 2,196,029 | 4/1940 | Palley | 172/238 |
| 2,292,829 | 8/1942 | Garin | 172/238 |
| 2,812,488 | 11/1957 | Wright | 323/47 |
| 2,864,994 | 12/1958 | Phillips | 323/114 |
| 2,930,964 | 3/1960 | Goodman | 323/48 |
| 3,018,434 | 1/1962 | Zocholl | 323/120 |
| 4,013,942 | 3/1977 | Boshnyaga et al. | 323/119 |
| 4,500,829 | 2/1985 | Specht et al. | 323/215 |
| 4,611,190 | 9/1986 | Montague | 336/10 |
| 4,837,497 | 6/1989 | Leibovich | 323/345 |
| 5,166,597 | 11/1992 | Larsen et al. | 323/215 |
| 5,300,870 | 4/1994 | Smith | 318/771 X |
| 5,469,044 | 11/1995 | Gyugyi et al. | 323/207 |
| 5,530,338 | 6/1996 | Beckwith | 323/255 |
| 5,698,969 | 12/1997 | Gyugyi | 323/207 |

*Primary Examiner*—Y. J. Han
*Attorney, Agent, or Firm*—Sand & Sebolt

[57] ABSTRACT

Autotransformer design which is capable of modifying the active power flow in autotransformers connecting two different voltage systems in an electrical substation. The bus-tie autotransformers presented change the active power flow by modifying the phase-angle between the primary and secondary voltages of the autotransformer. In accordance with the two tap changers are employed allowing for independent changes in both the voltage ratio and the phase-angle values.

9 Claims, 4 Drawing Sheets

Figure 1:
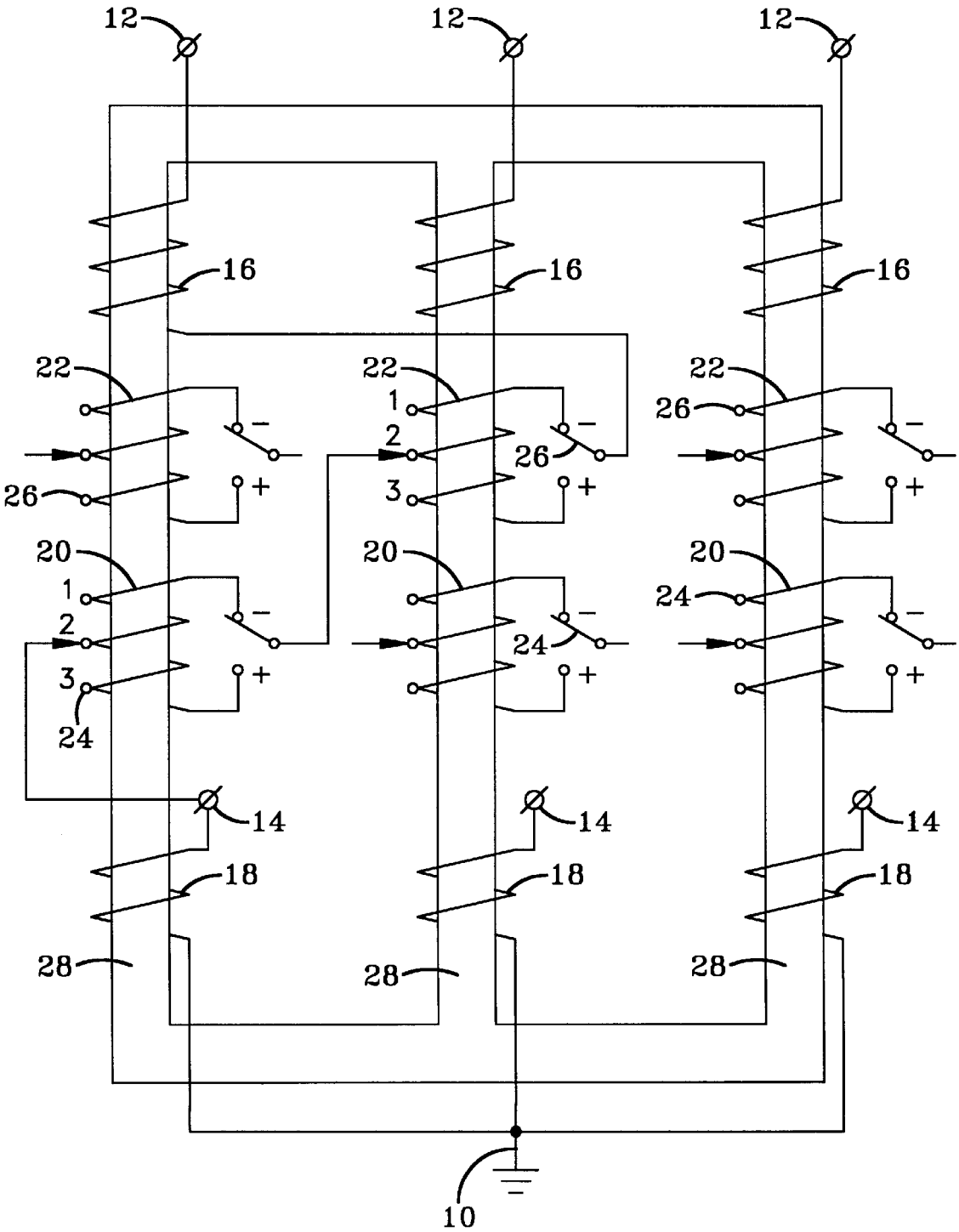

PHASE-ANGLE:

$$E_{12}\angle E_{14}\ (\text{RADIANS}) = \frac{0.866(\pm K_{26})E_{22}}{E_{16}+E_{18}+(\pm K_{24})E_{20}+0.5(\pm K_{26})E_{22}}$$

RATIO:

$$\frac{E_{12}}{E_{14}} = \frac{0.5(\pm K_{26})E_{22}}{E_{14} \times E_{12}\angle E_{14}\ (\text{RADIANS})}$$

FIG-3

| $K_{26}$ \ $K_{24}$ | −1.0 | −0.5 | 0 | +0.5 | +1.0 |
|---|---|---|---|---|---|
| +1.0 | 90<br>+5.5 | 92.5<br>+5.37 | 95<br>+5.25 | 97.5<br>+5.12 | 100<br>+5.0 |
| +0.5 | 92.5<br>+2.7 | 95<br>+2.65 | 97.5<br>+2.6 | 100<br>+2.55 | 102.5<br>+2.5 |
| 0 | 95<br>0 | 97.5<br>0 | 100<br>0 | 102.5<br>0 | 105<br>0 |
| −0.5 | 97.5<br>−2.5 | 100<br>−2.45 | 102.5<br>−2.4 | 105<br>−2.35 | 107.5<br>−2.3 |
| −1.0 | 100<br>−5.0 | 102.5<br>−4.87 | 105<br>−4.75 | 107.5<br>−4.62 | 110<br>−4.5 |

100% VOLTAGE−RATIO = 339/137.5 kV

FIG−4

THREE-PHASE AUTO TRANSFORMER WITH TWO TAP CHANGERS FOR RATIO AND PHASE-ANGLE CONTROL

TECHNICAL FIELD

The invention herein resides in the art of electrical power transmission. More particularly, the invention relates to auto transformers of the type employed in electrical power systems to connect two different voltage systems or buses in the same electrical substation. Specifically, the invention relates to an auto transformer which can modify the active and the reactive power flows between two voltage systems to optimize power system operation and improve auto transformer utilization.

BACKGROUND ART

In an electrical power system, auto transformers are often used to connect two different voltage systems or buses in an electrical substation. The auto transformers used in such bus-tie connections represent the majority of transformers in an electrical power system. In a conventional design auto transformer for bus-tie applications only the reactive power flow through the transformer can be modified by the means of so called voltage regulating winding and associated voltage tap changer. The active power flow through the transformer which is determined by the connected power system characteristics and the transformer short-circuit impedance can not be modified to accommodate for future power system developments. As a result, power system operation of a conventional auto transformer can become very uneconomical with time.

In the past, there have been auto transformers for bus-tie applications able to modify the active power flow through the transformer. These auto transformers use a so called pseudo phase-angle regulating winding and associated tap changer. The term pseudo indicates that the phase-angle and active power flow regulation is not an independent regulation and is accompanied by a reactive power flow and low voltage bus regulation. The reactive power flow and associated low voltage bus regulation determined by the active power flow regulation can be in a desired or non desired direction.

The present invention uses an auto transformer design with two independent regulating windings. For any practical purposes, selecting a particular tap position on the two regulating windings, any desired combination of phase-angle (active power flow) and voltage-ratio (reactive power flow) can be obtained. The invention provides for independent active and reactive power flow controls, the most desirable operation feature of an auto transformer used in system interconnection or bus-tie applications.

In the majority of the electrical power systems, the phase-angle between the high voltage and a low voltage buses in a substation is less than 10 degrees. As a consequence, only a small change in the phase-angle between primary and secondary induced voltages of an auto transformer connecting such voltage buses would produce significant changes in the active power flow through the auto transformer.

SUMMARY OF THE INVENTION

In light of the foregoing, it is the a first aspect of the invention to provide a simple, reliable and economic design of an auto transformer which allows for an easy modification of its internal characteristics to improve power system operation. Another aspect of the invention is the capability of an auto transformer to modify the active power flow through the transformer when connecting two different voltage systems or buses in an electrical substation.

Another aspect of the invention is the capability of an auto transformer to modify the reactive power flow through the transformer and change the voltage level on the low voltage bus when used in a substation connecting two different voltage systems.

Still a further aspect of the invention is the capability of an auto transformer to provide for independent changes in the active and the reactive power flows through the transformer including the ability to modify one power flow while keeping the other flow constant.

Still a further aspect of the invention is to provide for an auto transformer with a reliable, economical and easy to build design.

The foregoing and other aspects of the invention will become apparent after the detailed description of the design of the auto transformer with two regulating windings.

BRIEF DESCRIPTION OF THE DRAWINGS, EQUATIONS AND TABLES

Figure 2:
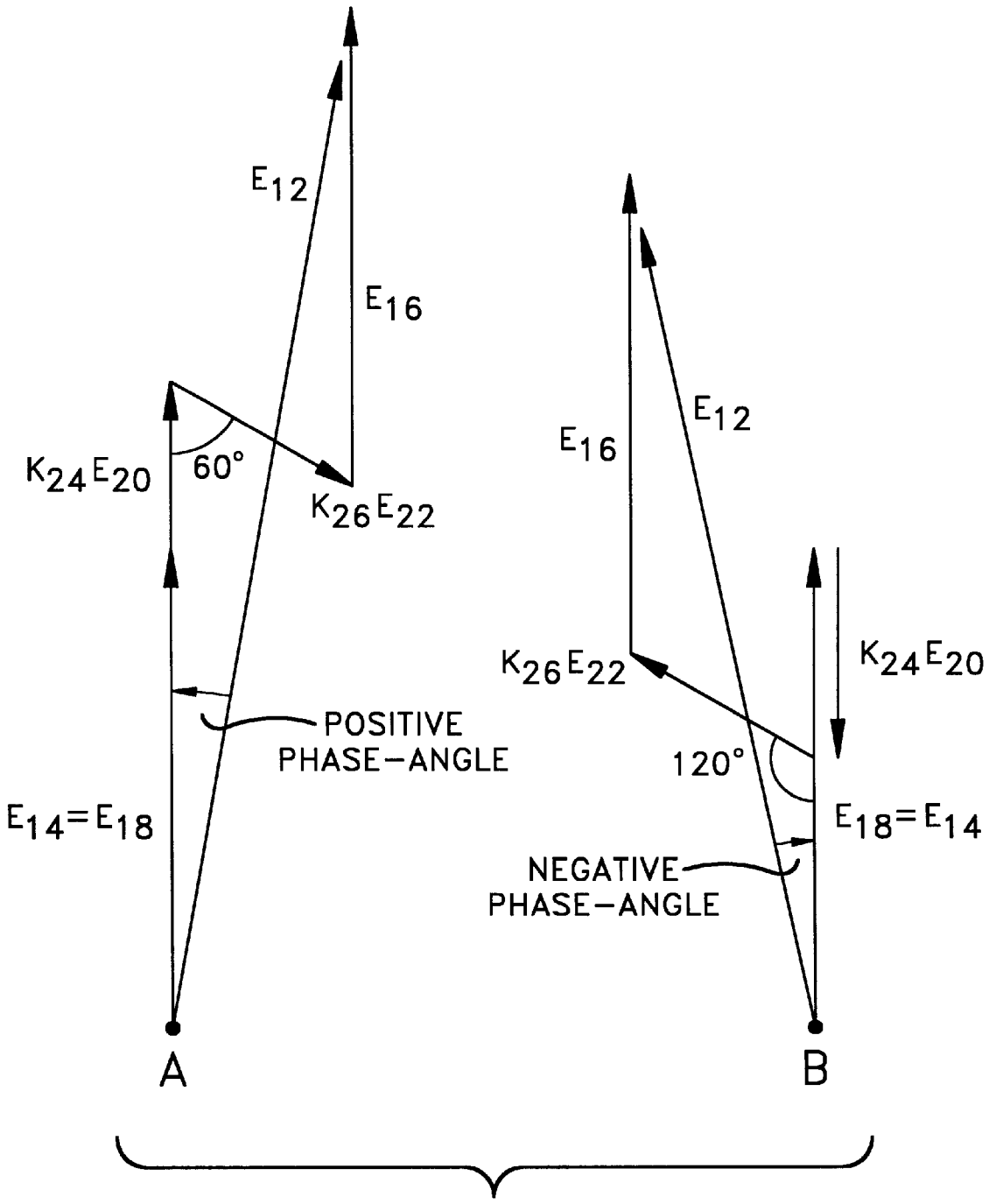

For a complete understanding of the objects, technique and structure of the invention reference should be made to the following detailed description and accompanying drawings, formulas and tables wherein:

FIG. 1 is an electrical schematic of a three-phase auto transformer made in accordance with an embodiment of the invention;

FIG. 2 presents the voltage vector diagram of one phase of a three-phase auto transformer made in accordance with the embodiment of the invention; and FIG. 3 presents the general equations to calculate the ratio and phase-angle between primary and secondary induced voltages at different tap positions of the two regulating windings for an auto transformer made in accordance with an embodiment of the invention;

FIG. 4 is a matrix showing the ratio and the phase-angle between primary and secondary induced voltages at different tap positions of the two regulating windings for a particular voltage rating auto transformer made in accordance with the embodiment of an invention.

BEST MODE FOR CARRYING OUT THE INVENTION

Referring now to the drawings and more particularly to FIG. 1, there can be seen an electrical schematic of a three-phase auto transformer in accordance with an embodiment of the invention which is adapted for bus-tie applications in electrical substations.

As shown in FIG. 1, the three-phase auto transformer has the three phases connected in wye with the neutral point 10 grounded. The auto transformer is interposed between a high voltage bus or line 12 and a low voltage bus or line 14, with the high voltage bus 12 being connected to the series windings 16 and the low voltage bus 14 being connected to the parallel windings 18. As a key to the invention herein, each phase of the three-phase auto transformer is provided with one in-phase regulating winding 22 and one 120° out-of-phase regulating winding 24.

In each phase of the three-phase auto-transformer the series 16, the parallel 18, the in-phase 20 and the 120° out-of-phase 22 windings are connected in series. The in-phase regulating winding 20 in a given phase is located on the same magnetic core leg 28 on which the series 16 and the parallel 18 windings pertaining to the same phase are also located. The 120° out-of-phase regulating winding 22 in a given phase is located on a different core leg than the windings 16, 18 and 20 pertaining to the same phase.

Both regulating windings are provided with one polarity switch and have a plurality of taps. The in-phase regulating winding 22 is provided with the polarity switch and taps 26 and the 120° out-of-phase regulating winding is provided with the polarity switch and taps 28. For the purpose of discussion, three taps numbered 1,2 and 3 are considered on each regulating winding.

As shown in the phase voltage vector diagram in FIG. 2, the various induced voltages in the windings connected in series in one phase determine the magnitudes and the phase-angle between primary E12 and secondary E14 induced voltages at the high voltage bus 12 and low voltage bus 14 terminals. The voltage induced in a particular winding is designated by the same number which designates the winding itself. For instance E16 is the voltage induced in the series winding 16.

The coefficients K24 and K26, which can be positive or negative numbers, designate the polarity and tap positions on the in-phase 24 and on the 120° out-of-phase 26 regulating windings. For instance, if the two regulating windings 24 and 26 will each have three, equally spaced taps and one polarity switch, the values of K24 and K26 will be: 0, +/−0.5 and +/−1.0.

The ratio and the phase-angle between the primary and the secondary induced voltages E12 and E14 can be calculated with the approximate formulas in FIG.3. Because of the small value of the phase-angle between E12 and E14, less than 10°, the value of the angle in radians can be approximated by the sinus or the tangent values.

FIG.4 matrix shows the possible voltage-ratio and phase-angle combinations for a particular voltage rating auto transformer calculated with the general formulas in FIG. 3. The 339/137.5 kV three-phase auto transformer considered in the FIG. 4 matrix has the following voltage ratings:

$$E18=137.5/\sqrt{3}=79.4 \text{ kV},$$

$$E16=(339-137.5)/\sqrt{3}=116.5 \text{ kV},$$

$$E20=0.05\ 339/\sqrt{3}=9.8 \text{ kV}$$

$$E22=0.1\ 339/\sqrt{3}=19.6 \text{ kV}.$$

Both regulating windings 20 and 22 have three equally spaced taps and one polarity switch.

The ratio and phase-angle combinations for this particulate autotransformer are arranged in 5 by 5 matrix which corresponds to the different positions of the polarity switches and the tap changers on the regulating windings. The central position in the FIG. 4 matrix (line 3, column 3) corresponds to 339/137.5 kV=100% voltage-ratio and 0° phase-angle between primary and secondary induced voltages E12 and E14. The two regulating windings 20 and 22 are out from the phase circuit in all three phases and K24=K26=0 in this case.

As it can be seen from the matrix of FIG. 4, the auto transformer made in accordance with the embodiment of this invention is capable to regulate the phase-angle between primary and secondary induced voltages E12 and E14 by keeping their ratio constant. On the matrix positions located on diagonals between the lower-left corner and the upper right corner, the ratio E12/E14 is constant while the phase-angle between E12 and E14 varies from maximum positive to minimum negative.

The horizontal lines in the same FIG. 4 matrix show that the voltage-ratio E12/E14 can be regulated by keeping the phase-angle between E12 and E14 almost constant.

Thus it can be seen that the objects of the invention have been satisfied by the structure presented above. While in accordance with the patent statutes only the best mode and preferred embodiment of the invention has been presented and described in details, it is to be understood that the invention is not limited thereto or thereby. Accordingly, for an appreciation of the true scope and breadth of the invention reference should be made to the following claims.

What is claimed is:

1. A three-phase auto transformer interposed between high and low voltage buses in an electrical substation connecting two different voltage systems, the auto transformer having two regulating windings in each phase, one of the two said regulating windings being an in-phase regulating winding and the other regulating winding being a 120° out-of-phase regulating winding, and wherein said in-phase regulating winding in a phase is located on the same magnetic core leg where the series and parallel windings of the same phase are also located and said 120° out-of-phase regulating winding is located on a different magnetic core leg on which the series, the parallel and the in-phase regulating windings of a different phase are located.

2. The auto transformer according to claim 1, wherein each said regulating winding has a plurality of taps and one polarity switch.

3. The auto transformer according to claim 2, wherein to each combination of tap positions and polarity switches on the two regulating windings corresponds one ratio and one phase-angle between primary and secondary induced voltages.

4. The auto transformer according to claim 2, wherein the voltage ratings and the number of taps of the two regulating windings can be determined to obtain any desired ratio/phase-angle combinations between primary and secondary induced voltages.

5. The auto transformer according to claim 4, wherein by changing the tap position on the two regulating windings the active and the reactive power flows through the transformer connecting two different voltage systems can by modified.

6. The auto transformer according to claim 5, wherein the active power flow through the transformer can be regulated independently from the reactive flow regulation though the same transformer.

7. The auto transformer according to claim 6, wherein the active power flow regulation by keeping the voltage-ratio constant allows for an economical operation in parallel with a conventional auto transformer with similar MVA and voltage-ratio and different short-circuit impedance value.

8. The auto transformer according to claim 7, wherein the short-circuit impedance value can be higher than for a conventional auto transformer to limit the short-circuit current magnitude and yet can provide for larger active power flow than the conventional transformer.

9. The auto transformer according to claim 5, wherein the reactive power flow through the transformer and the voltage level on the low voltage bus to which the transformer is connected, can be regulated independently from the active power flow through the same transformer.

* * * * *